US009754735B2

(12) United States Patent
Eismann et al.

(10) Patent No.: US 9,754,735 B2
(45) Date of Patent: Sep. 5, 2017

(54) CONTACT UNIT FOR AN ELECTROMECHANICAL SWITCHING DEVICE

(71) Applicant: Siemens Aktiengesellschaft, Munich (DE)

(72) Inventors: Andreas Eismann, Hirschaid (DE); Horst Greiner, Forchheim (DE); Oliver Ibisch, Parkstein (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/969,646

(22) Filed: Dec. 15, 2015

(65) Prior Publication Data

US 2016/0172140 A1 Jun. 16, 2016

(30) Foreign Application Priority Data

Dec. 15, 2014 (DE) ..... 10 2014 225 810

(51) Int. Cl.
*H01H 1/02* (2006.01)
*H01H 1/027* (2006.01)
*H01H 1/023* (2006.01)

(52) U.S. Cl.
CPC ..... *H01H 1/027* (2013.01); *H01H 1/023* (2013.01)

(58) Field of Classification Search
CPC ..... H01H 1/02; H01H 1/0201; H01H 1/023; H01H 3/02; H01H 3/14; H01H 35/00; H01H 1/00; H01H 1/021; H01H 1/027; H01H 1/029; H01H 1/04; H01H 2201/00; H01H 2201/022; H01H 2201/024; H01H 2201/026; H01H 2201/03; H01H 2209/00; H01H 2209/002; H01H 2209/016
USPC ..... 200/268, 262, 263, 265, 266, 270; 420/501; 428/357, 379, 380, 402, 411.1, 428/425.9
See application file for complete search history.

(56) References Cited

U.S. PATENT DOCUMENTS

| | | | | |
|---|---|---|---|---|
| 6,431,758 B1 * | 8/2002 | Lyon | F16C 33/121 | 384/276 |
| 2006/0261719 A1 * | 11/2006 | Fox | H01J 9/025 | 313/311 |
| 2015/0086417 A1 * | 3/2015 | Liu | C22C 26/00 | 420/501 |

FOREIGN PATENT DOCUMENTS

| | | | | |
|---|---|---|---|---|
| CN | 1555074 A | | 12/2004 | H01B 1/02 |
| CN | 100487839 A | * | 11/2007 | H01H 1/021 |
| CN | 201788917 U | | 4/2011 | H01H 73/04 |
| CN | 103745842 A | | 4/2014 | C22C 1/05 |
| JP | H11238430 A | * | 8/1999 | H01H 21/285 |
| WO | 2014/024569 A1 | | 2/2014 | H01B 1/04 |

OTHER PUBLICATIONS

Chinese Office Action, Application No. 201510920579.8, 7 pages, dated May 2, 2017.

* cited by examiner

*Primary Examiner* — Anthony R. Jimenez
(74) *Attorney, Agent, or Firm* — Slayden Grubert Beard PLLC

(57) ABSTRACT

A contact unit for an electromechanical switching device includes a carrier element and a contact element connected to the carrier element. The contact element has a silver-containing layer that provides a contact area for making releasable contact with a further contact area of the switching device depending on a switching state of the switching device. The silver-containing layer includes diamond particles at least in the region of the contact area.

18 Claims, 1 Drawing Sheet

CONTACT UNIT FOR AN ELECTROMECHANICAL SWITCHING DEVICE

CROSS-REFERENCE TO RELATED APPLICATIONS

This application claims priority to DE Application No. 10 2014 225 810.3 filed Dec. 15, 2014, the contents of which are hereby incorporated by reference in their entirety.

TECHNICAL FIELD

The present invention relates to a contact unit for an electromechanical switching device, comprising a carrier element and also comprising a contact element which is connected to the carrier element, wherein the contact element has a silver-containing layer which provides a contact area for making releasable contact with a further contact area of the switching device depending on a switching state of the switching device. Furthermore, the invention also relates to an electromechanical switching device comprising at least two connections which are arranged such that they are electrically insulated from one another, at least one contact unit which is connected to one of the connections, a further contact area which is connected to another of the connections, and also a drive unit, which is mechanically connected to the contact unit, for a contact area which is provided by one contact element of the contact unit to make releasable contact with the further contact area of the electromechanical switching device depending on a switching state of the electromechanical switching device.

BACKGROUND

Contact units and electromechanical switching devices of the generic type are known in principle, and therefore separate documentary evidence of this is not required. Electromechanical switching devices of the generic type are used to interrupt and, respectively, to close electrical circuits in a predefinable manner by providing an electromechanical switching contact, depending on a switching state of the switching contact. To this end, said electromechanical switching devices can comprise a manually and/or an automatically operable drive unit by means of which the switching contact can be moved to the desired switching state. The drive unit operates at least one of the contact units in order to be able to provide the desired switching state in the electromechanical switching device. Electromechanical switching devices of the generic type comprise, for example, single- or multiple-pole electromechanical switches which can be operated, for example manually, by means of an operating element. The operating element can be used to change from one switching state of the electronic mechanical switching device to another switching state of the electromechanical switching device. If the operating element is designed for manual operation, it can be formed, for example, by a pushbutton, a switching lever, a rotary lever, combinations of these and/or the like. If automatic operation is provided, the drive unit can also be designed in such a way that it can be operated in a magnetic, electrical, pneumatic and/or hydraulic manner or the like in order to be able to provide a desired switching state of the electromechanical switching device. A drive unit for magnetic operation is present, for example, in a relay, a contactor or the like.

The contact unit of the electromechanical switching device serves to provide a contact surface by means of the contact element which is connected to the carrier element, wherein the respective contact areas mechanically touch or are positioned in a manner physically spaced apart from one another by virtue of a mechanical movement of the carrier element with the contact element depending on the respective switching state of the electromechanical switching device. An electrically conductive connection can be established in the switching state in which contact is made between the contact areas. The electrical connection is interrupted in the spaced-apart state.

Electromechanical switching devices of the generic type and corresponding contact units are used, in particular, in low-voltage switch disconnectors, low-voltage circuit breakers and/or the like. In the prior art, it is customary to use a silver-based material which forms the respective contact element and provides the respective contact area. Furthermore, the silver-based layer comprises a small proportion of graphite.

In electromechanical switching devices, contact materials are usually intended to realize contact resistances which are as low as possible when the electromechanical switching device is in the switched-on state. However, at the same time, a low level of material loss and also a low tendency to weld are intended to be achieved during operation as intended. However, these properties contradict one another. Although the silver-based contact material with the addition of graphite has proven expedient, there is still a need for improvement, in particular with respect to the durability of the switching device and reliable operation.

SUMMARY

One embodiment provides a contact unit for an electromechanical switching device, comprising a carrier element and also comprising a contact element which is connected to the carrier element, wherein the contact element has a silver-containing layer which provides a contact area for making releasable contact with a further contact area of the switching device depending on a switching state of the switching device, wherein the silver-containing layer comprises diamond particles at least in the region of the contact area.

In a further embodiment, a proportion of diamond particles in the silver-containing layer is at least 2% by weight at least in the region of the contact area.

In a further embodiment, the proportion of diamond particles in the silver-containing layer is at most 10% by weight at least in the region of the contact area.

In a further embodiment, a silver layer is arranged between the carrier element and the silver-containing layer.

In a further embodiment, the silver layer has a greater layer thickness than the silver-containing layer.

In a further embodiment, an average particle size of the diamond particles is approximately 1 μm to 50 μm.

In a further embodiment, the carrier element comprises copper.

In a further embodiment, the silver-containing layer has a layer thickness in a range of from 100 μm to 500 μm.

In a further embodiment, the contact area has an area of at most 200 $cm^2$, preferably 50 $cm^2$.

In a further embodiment, the diamond particles are doped with a substance which provides the diamond particles with a good level of electrical conductivity.

Another embodiment provides an electromechanical switching device comprising at least two connections which are arranged such that they are electrically insulated from one another, at least one contact unit which is connected to one of the connections, a further contact area which is connected to another of the connections, and also a drive unit, which is mechanically connected to the contact unit, and wherein the at least one contact unit comprises a carrier element, and a contact element connected to the carrier element, wherein the contact element has a silver-containing layer that provides a contact area for making releasable contact with the further contact area depending on a switching state of the electromechanical switching device, and wherein the silver-containing layer comprises diamond particles at least in a region of the contact area.

BRIEF DESCRIPTION OF THE DRAWINGS

Example embodiments are described in further detail below with reference to the figures, in which.

DETAILED DESCRIPTION

Figure 1:
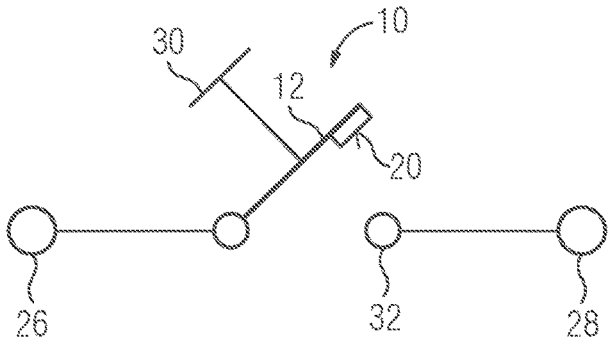
FIG. 1 shows a schematic illustration of an example circuit diagram of a manually operable low-voltage circuit breaker according to one embodiment of the invention.

Embodiments of the invention provide an improved contact unit and an electromechanical switching device.

Some embodiments provide a generic-type contact unit in which the silver-containing layer comprises diamond particles at least in the region of the contact area.

Other embodiments provide an electromechanical switching device having such a contact unit.

The contact unit has a carrier element which is designed to carry a contact element which is connected to the carrier element. In the case of an electromechanical switching device, at least one contact unit can preferably be mechanically moved, so that a contact area which is provided by the contact element can make releasable contact with a further contact area of the switching device depending on a respective switching state of the switching device. As a result, an electrically conductive connection can be provided between the electrical connections with which the respective contact areas are each electrically conductively in contact, depending on the respective switching state of the switching device.

The silver-containing layer, also called the silver-based layer, contains silver for the most part. The proportion of silver is preferably more than 90% by weight. In addition to the diamond particles, the silver-containing layer can also contain small amounts of further substances. Further substances can be, for example, tungsten, cadmium, nickel, silicon, copper, palladium, chromium, manganese, molybdenum, alloys of these and/or the like, for example tungsten carbide or the like.

According to embodiments, the thermal conductivity and/or the stability can be improved in the switched-on state of the switching device with the electrical conductivity at least remaining the same. This is achieved by the use of the diamond particles which can substantially replace the graphite in comparison to the use of graphite cited in the introductory part in relation to the prior art. The thermal conductivity in the region of the contact surface during operation of the contact unit or of the electromechanical switching device as intended can be considerably improved in this way. This has the advantage that, when the electromechanical switching device is open, that is to say when two surfaces of two contact units which are in contact are released, an arc which is produced in the process can be cooled more effectively. The contact area of the contact element usually melts in the event of arc loading. In the process, silver is evaporated and/or sprayed on account of the accompanying high temperature. Since the contact surface can be cooled more effectively and/or the heat can be dissipated more rapidly by means of the invention, a time at which the contact area melts can be considerably delayed. This has the effect that less material is removed from the contact area. Therefore, the contact unit can be designed firstly to be smaller than was previously possible in the prior art given the same loading capacity and/or secondly improved stability and, respectively, ability to withstand switching play can be achieved. In the process, the invention allows the electrical conductivity to be at least maintained, in particular in the contact-connected state of the contact areas.

The advantage is achieved, in particular, by the thermal conductivity of the diamond particles generally being better at least approximately by a factor of 5 than that of silver. The thermal conductivity of the diamond particles is, for example, in a range of from 1000 to 2500 W/mK. In contrast, silver only has a thermal conductivity of 429 W/mK.

However, the invention also results in a high shock resistance, good thermal stability and also a high impact strength. At the same time, it has been found that the production process for the contact elements can likewise be improved on account of the good flowability of the silver-containing layer which is provided with diamond particles. Furthermore, it has been found to be advantageous that the oxidation behavior which, in principle, is similar to that with graphite shifts to higher temperatures.

The abovementioned properties and advantages produce a contact material for the contact element which has a relatively high stability, in particular under the influence of an arc. This results in a lower level of material removal or material loss in comparison to conventional contact elements which comprise, for example, silver admixed with graphite. As a result, the volume of the contact elements given a comparative switching power can be reduced as a result, this additionally allowing cost savings to be made.

One of the larger heat sources in the case of an electromechanical switching device is generally the contact point which is formed by the contact-connection of two contact areas. A contact resistance of a contact point which is formed in this way can vary greatly depending on the levels of loading and soiling of the contact elements or contact surfaces. In order to avoid a "hotspot" or a locally overheated point or else overloading of the contact units, it should be possible to dissipate the heat from the contact area as rapidly as possible. This can be achieved by the invention because, owing to the high thermal conductivity of the diamond particles, the heat can be rapidly dissipated from the point of origin in the region of the contact point, through the comparatively small contact elements, to the carrier element.

Carrier elements generally have a high mass in comparison to the contact element, as a result of which a heat sink can be provided, it being possible for the contact element to be cooled by said heat sink. At the same time, the carrier element generally also serves to establish the electrical connection to the contact element or to the contact surface. To this end, said carrier element is generally formed from an electrically conductive material.

The abovementioned cooling effect further results in other materials also being subjected to less thermal loading in the region of the contact unit, in particular if said materials are plastics. Furthermore, the stability of the contact units can be improved, in particular when a connection between the contact element and the carrier element is formed by a solder which can be, for example, a hard solder based on silver. During manufacturing, the hard solder is applied to the carrier element, for example, in the form of a paste and/or a foil, and then the contact element is fitted. The connection between the carrier element and the contact element is then established by subsequent thermal treatment. The invention and the improved cooling effect which is produced by the invention can also result in improved durability of the connection between the contact element and the carrier element.

Furthermore, the invention allows $CO_2$ which is produced under the influence of an arc to be used in order to achieve a protective gas effect which further reduces the further unfavorable influence of the arc on the contact element or the contact area.

In one embodiment of the invention, the diamond particles are doped with a substance which provides the diamond particles with a good level of electrical conductivity. A substance of this kind may be, for example, boron, phosphorus, nitrogen or the like. Combinations of these can also be provided in order to simplify a production process for the diamond particles for example. The advantageous effect of the diamond particles in respect of the switching properties can be further improved in this way.

In one embodiment, the diamond particles are mixed with graphite particles to be provided in the silver-containing layer. By way of example, a certain proportion of the diamond particles can be replaced by graphite particles. However, provision may also be made for the proportion of graphite particles to be provided in addition to the proportion of diamond particles.

The diamond particles can advantageously also be arranged in the silver-containing layer at least predominately in such a way that they make contact with the contact area. As a result, the use of the diamond particles can be further optimized in respect of the effectiveness of said diamond particles.

In one embodiment a proportion of diamond particles in the silver-containing layer is at least 2% by weight at least in the region of the contact area. As a result, a particularly high electrical conductivity can be achieved when the contact areas are in contact-connection with one another. However, the diamond particles are particularly advantageously arranged in a substantially uniformly distributed manner in the silver-containing layer.

In one embodiment, the proportion of diamond particles in the silver-containing layer is at most 10% by weight at least in the region of the contact area. As a result, a particularly high level of cooling together with good electrical conductivity can be achieved by contact areas which are in contact-connection with one another.

One embodiment provides a silver layer arranged between the carrier element and the silver-containing layer. The silver layer can be a comparable alloy, as has already been indicated above in respect of the silver-containing layer. However, said silver layer can also comprise pure silver. The silver layer may have the effect that a reliable connection can be established between the silver-containing layer and the carrier element. The silver layer can be applied in the form of a paste or a foil and be processed by means of thermal treatment in order to be able to establish a preferably cohesive connection between the silver-containing layer and the silver layer. Furthermore, the silver layer and the silver-containing layer may be integrally formed with one another. In contrast to the silver-containing layer, the silver layer preferably contains substantially no diamond particles. A reliable homogeneous connection can be achieved as a result.

The silver layer generally has a smaller layer thickness than the silver-based layer, in particular when the silver layer serves only to connect the silver-containing layer to the carrier element. However, under certain boundary conditions, it may be expedient when, according to a further embodiment, the silver layer has a greater layer thickness than the silver-based layer. As a result, expenditure on the silver-containing layer, which also contains the diamond particles, could therefore be reduced. It is therefore possible to considerably reduce the layer thickness of the silver-containing layer in comparison to the prior art using the invention.

In one embodiment, an average particle size of the diamond particles is in a range of from 1 μm to 50 μm. The average particle size can be selected, for example, depending on a respective intended switching application in order to be able to adjust the properties of the silver-containing layer and the durability of the contact area as well as possible. By way of example, the thickness of the silver-based layer can be dependent on the particle size. A lower layer thickness can be provided with a small particle size than with a large particle size. It is also possible to precisely select a specific particle size for the diamond particles in order to be able to set the material properties of the contact element and of the contact area in a predefinable manner. Provision can also be made, for example, for the average particle size of the diamond particles to be selected in a range of from 2 μm to 15 μm, particularly preferably of from 5 μm to 10 μm. Furthermore, provision can be made in alternative embodiments for the average particle size of the diamond particles to lie in a range of from 10 μm to 50 μm. As a result, the invention can make use of it being possible to use industrial diamond powder as a source for diamond particles. Therefore, diamond particles can be provided in a simple and cost-effective manner for the purposes of the invention.

According to one embodiment, the carrier element comprises copper. As a result, the carrier element can not only provide a reliable carrier function but it can furthermore also make good electrical and thermal coupling of the contact element possible. In particular spring-elastic, copper alloys can be provided in order to be able to set desired mechanical and electrical and thermal properties in a predefinable manner. Copper has also been found to be particularly advantageous because it can be easily connected to the silver-containing layer and possibly also the silver layer.

The silver-containing layer may have a layer thickness in a range of from 100 μm to 500 μm. It has been found that a reliable and durable contact area which is also cost-effective can be achieved with these layer thicknesses. In contrast, the layer thickness of the silver layer can be in the range of from approximately 100 μm to approximately 200 μm.

In one embodiment, the contact area has an area of at most 200 $cm^2$, preferably 50 $cm^2$. As a result, the contact unit according to the invention can be integrated very easily into existing switching devices.

The contact area can also be selected in a range of from approximately 50 $cm^2$ to approximately 200 $cm^2$. Said contact area can also be selected to be smaller than 50 $cm^2$ in particular.

FIG. 1 shows a schematic illustration of a circuit diagram of an electromechanical switching device 10 in the form of a low-voltage circuit breaker according to one embodiment of the invention. The low-voltage circuit breaker 10 comprises two connections 26 and 28 which are arranged in a manner electrically insulated from one another and which are connected to electrical lines, not illustrated, of an electrical circuit, likewise not illustrated. The low-voltage circuit breaker 10 serves to establish an electrically conductive connection between the connections 26 and 28 in a desired manner. Said electrically conductive connection is established depending on a switching state of the low-voltage circuit breaker 10. To this end, the low-voltage circuit breaker 10 can be manually operated by means of a switching knob 30 as a drive unit.

The switching knob 30 acts on a contact unit 12, which may be pivotably mounted. The contact unit 12 is a constituent part of the low-voltage circuit breaker 10 and establishes the electrical connection between the connections 26 and 28 depending on the switching state of the low-voltage circuit breaker 10.

In other embodiments, the switching knob 30 may be replaced or supplemented by an automatic drive in order to be able to remotely control, for example, the low-voltage circuit breaker 10.

The contact unit 12 comprises a contact area 20 which can be pivoted by means of the switching knob 30. In the switched-on state of the low-voltage circuit breaker 10, the contact area 20 makes contact with a stationary, further contact area 32 of the low-voltage circuit breaker 10. The contact area 32 is electrically conductively connected to the connection 28, whereas the contact area 20 is electrically conductively connected to the connection 26.

In other embodiments the contact area 32 may be arranged in a movable or pivotable manner and preferably to be able to be operated by means of the drive unit, for example the switching knob 30. A further contact unit can accordingly be provided, said further contact unit being arranged to interact with the contact unit 12.

Figure 2:
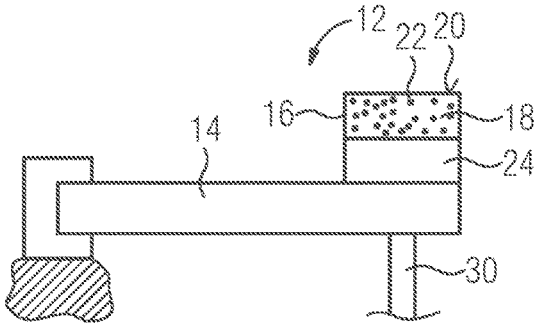
FIG. 2 shows a schematic side view of an example contact unit according to one embodiment.

FIG. 2 shows an enlarged schematic basic illustration of a side view of the contact unit 12 according to FIG. 1. The contact unit 12 comprises a contact element 16 which comprises a silver-containing layer 18. The contact element 16 provides the contact area 20. The contact area 20 serves to make releasable contact with the further contact area 32.

The silver-containing layer 18 comprises diamond particles 22 which have an average particle size of 20 μm in the present case. The diamond particles 22 may be arranged in a manner distributed substantially uniformly in the silver-containing layer 18. In the present case, the proportion by weight of diamond particles 22 in the silver-containing layer 18 is approximately 5% by weight.

The silver-containing layer 18 is connected to a silver layer 24 which, for its part, establishes a connection to a carrier element 14 of the contact unit 12. In the present case, the carrier element 14 is formed from a copper alloy. In addition to good electrical and thermal conductivity, said carrier element also has a degree of spring elasticity in the present case, so that a separate, articulated arrangement of the contact unit 12 in the low-voltage circuit breaker 10 is not required. The contact unit 12 can be moved, in this case pivoted, to the desired switching position by means of the switching knob 30.

Figure 3:
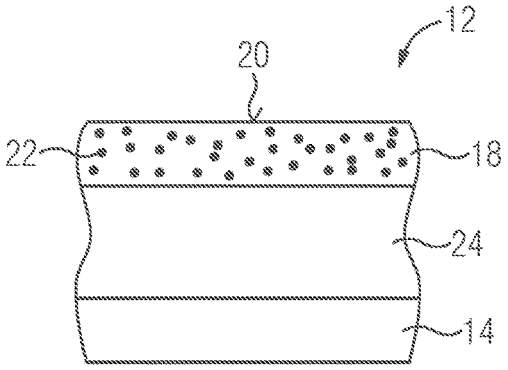
FIG. 3 shows a schematic illustration of a detail of an example layer structure of the contact unit according to FIG. 2.

FIG. 3 shows a schematic illustration of a detail of the structure of the contact unit 12 in the region of the contact area 20. The layer structure is made up as follows according to FIG. 3. The silver-containing layer 18 which also comprises the diamond particles 22 is situated at the very top. The silver-containing layer 18 is formed with a layer thickness of approximately 120 μm in the present case.

A silver layer 24, which has a layer thickness of approximately 100 μm in the present case, is connected to the silver-containing layer 18 below the silver-containing layer 18. In alternative embodiments, the layer thickness of the silver layer 24 can vary between 100 μm and 200 μm, depending on the construction of the contact unit 12 in respect of the intended application. In the present case, the silver layer 24 comprises a silver alloy which substantially contains silver and has only a very small proportion of further substances in order to be able to ensure the connecting effect in a long-lasting and reliable manner.

The carrier element 14 adjoins the silver layer 24 and is likewise firmly connected to the silver layer 24. In order to establish the connection between the layers according to FIG. 3, provision can be made for the carrier element 14 to be coated with the silver layer 24 in the form of a foil or paste and for the silver-containing layer 18 comprising the diamond particles 22 to be applied to said silver layer. This is followed by thermal treatment, so that an, in particular cohesive, connection is established between the different layers 14, 18, 24.

The exemplary embodiment illustrated above serves merely to explain the invention and does not restrict said invention. In particular, features and refinements can be combined with one another in any desired manner in order to arrive at further refinements which meet requirements, without departing from the concept of the invention. Furthermore, apparatus features can also occur as method features and vice versa.

What is claimed is:

1. A contact unit for an electromechanical switching device, the contact unit comprising:

a carrier element; and a contact element connected to the carrier element, wherein the contact element has a silver-containing layer that provides a contact area for making releasable contact with a further contact area of the switching device depending on a switching state of the switching device, and wherein the silver-containing layer comprises diamond particles at least in a region of the contact area and a proportion of diamond particles in the silver-containing layer is at least 2% by weight at least in the region of the contact area.

2. The contact unit of claim 1, wherein the contact area has an area of at most 50 $cm^2$.

3. The contact unit of claim 1, wherein the proportion of diamond particles in the silver-containing layer is at most 10% by weight at least in the region of the contact area.

4. The contact unit of claim 1, wherein an average particle size of the diamond particles is approximately 1 μm to 50 μm.

5. The contact unit of claim 1, wherein the carrier element comprises copper.

6. The contact unit of claim 1, wherein the silver-containing layer has a layer thickness in a range of from 100 μm to 500 μm.

7. The contact unit of claim 1, wherein the contact area has an area of at most 200 $cm^2$.

8. The contact unit of claim 1, wherein the diamond particles are doped with a substance that increases the electrical conductivity of the diamond particles.

9. The contact unit of claim 1, comprising a silver layer arranged between the carrier element and the silver-containing layer.

10. The contact unit of claim 9, wherein a layer thickness of the silver layer is greater than a layer thickness of the silver-containing layer.

11. The contact unit of claim 9, wherein a layer thickness of the silver layer is greater than a layer thickness of the silver-containing layer.

12. An electromechanical switching device, comprising:

at least two connections arranged such that they are electrically insulated from one another, at least one contact unit connected to one of the connections, a further contact area connected to another of the connections, and a drive unit mechanically connected to the contact unit, wherein the at least one contact unit comprises:

a carrier element, and a contact element connected to the carrier element, wherein the contact element has a silver-containing layer that provides a contact area for making releasable contact with the further contact area depending on a switching state of the electromechanical switching device, and wherein the silver-containing layer comprises diamond particles at least in a region of the contact area and a proportion of diamond particles in the silver-containing layer is at least 2% by weight at least in the region of the contact area.

13. The electromechanical switching device of claim 12, wherein the proportion of diamond particles in the silver-containing layer is at most 10% by weight at least in the region of the contact area.

14. The electromechanical switching device of claim 12, comprising a silver layer arranged between the carrier element and the silver-containing layer.

15. The electromechanical switching device of claim 12, wherein an average particle size of the diamond particles is approximately 1 μm to 50 μm.

16. The electromechanical switching device of claim 12, wherein the carrier element comprises copper.

17. The electromechanical switching device of claim 12, wherein the silver-containing layer has a layer thickness in a range of from 100 μm to 500 μm.

18. The electromechanical switching device of claim 12, wherein the contact area has an area of at most 200 $cm^2$.

* * * * *